US010290950B1

(12) United States Patent
Crocker et al.

(10) Patent No.: US 10,290,950 B1
(45) Date of Patent: May 14, 2019

(54) DUAL-BAND GPS ANTENNA WITH HORIZONTAL POLARIZATION

(71) Applicant: National Technology & Engineering Solutions of Sandia, LLC, Albuquerque, NM (US)

(72) Inventors: Dylan Andrew Crocker, Albuquerque, NM (US); Bernd H. Strassner, II, Albuquerque, NM (US); Troy Satterthwait, Rio Rancho, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 34 days.

(21) Appl. No.: 15/684,560

(22) Filed: Aug. 23, 2017

Related U.S. Application Data

(60) Provisional application No. 62/487,561, filed on Apr. 20, 2017.

(51) Int. Cl.
*H01Q 1/24* (2006.01)
*H01Q 21/00* (2006.01)
*H01Q 21/06* (2006.01)

(52) U.S. Cl.
CPC ..... *H01Q 21/062* (2013.01); *H01Q 21/0006* (2013.01); *H01Q 1/24* (2013.01)

(58) Field of Classification Search
CPC ..... H01Q 21/062; H01Q 21/0006; H01Q 1/24
USPC ..... 343/795
See application file for complete search history.

(56) References Cited

U.S. PATENT DOCUMENTS 9,209,526 B2 * 12/2015 Gao ..... H01Q 21/26
9,608,326 B2 * 3/2017 Singh ..... H01Q 7/00
9,941,595 B2 * 4/2018 Yang ..... H01Q 19/005
10,056,700 B2 * 8/2018 Kim ..... H01Q 21/065

OTHER PUBLICATIONS

Quan, et al., "Development of a Broadband Horizontally Polarized Omnidirectional Planar Antenna and Its Array for Base Stations", in Progress in Electromagnetics Research, vol. 128, 2012, pp. 441-456.

* cited by examiner

*Primary Examiner* — Brian K Young
(74) *Attorney, Agent, or Firm* — Medley, Behrens & Lewis, LLC

(57) ABSTRACT

An antenna array is described herein that is suitable for dual-band GPS reception. The antenna array includes a plurality of dipole antennas arranged in a circular pattern. The antenna array further includes a feed network, separated from the dipole antennas by an insulating plate, and that passes electrical signals output by the dipole antennas to a feed line. The feed network comprises a central plate in contact with the feed line, and a plurality of arms aligned with the dipoles and extending from the center plate toward the outer edges of the circular pattern. The arms cross over slots in each of the dipole antennas. Electromagnetic waves that impinge on the dipoles induce signals that travel down the slots in the dipoles and couple to the arms of the feed network where the arms cross over the slots. The signals then travel along the feed network to the feed line.

19 Claims, 7 Drawing Sheets

DUAL-BAND GPS ANTENNA WITH HORIZONTAL POLARIZATION

RELATED APPLICATION

This application claims priority to U.S. Provisional Patent Application No. 62/487,561, filed on Apr. 20, 2017, and entitled "DUAL-BAND GPS ANTENNA WITH HORIZONTAL POLARIZATION", the entirety of which is incorporated herein by reference.

STATEMENT OF GOVERNMENTAL INTEREST

This invention was made with Government support under Contract No. DE-NA0003525 awarded by the United States Department of Energy/National Nuclear Security Administration. The U.S. Government has certain rights in the invention.

BACKGROUND

GPS and other antennas are currently incorporated in a wide variety of devices and systems with varying constraints as to size, weight, proximity to other radiating components, etc. For instance, modern portable smartphones may incorporate GPS, 4G, Bluetooth, and other antennas all located in close proximity (e.g., within six or fewer inches) of one another and other potentially-radiating circuit components. In many applications, interference on an antenna from other components in a device or system is unavoidable, and has a detrimental impact on the performance of the antenna (i.e., the ability of the antenna to receive a desired signal and reject others).

SUMMARY

The following is a brief summary of subject matter that is described in greater detail herein. This summary is not intended to be limiting as to the scope of the claims.

Technologies pertaining to an antenna array suitable for use as a dual-band GPS antenna are described herein. The antenna array described herein is suitable for use in environments in which other radiating antennas and metallic structures are in close proximity to the antenna array. In an exemplary embodiment, the antenna array comprises a plurality of dipole antennas arranged in a circular pattern. Each of the dipole antennas comprises a pair of straight arm portions that extend outward from a central point. Each of the dipole antennas further comprises a pair of arc-shaped portions extending from the straight arm portions such that the outer edges of the arc-shaped portions form a circle. The exemplary antenna array further comprises a feed network separated from the circular arrangement of dipole antennas by an insulating plate. In the exemplary array, the feed network comprises a central plate and a plurality of arms that extend from the central plate. Each of the arms that extends from the central plate crosses over a slot between the straight arm portions of a respective dipole, such that an electrical signal at a slot couples capacitively to the feed network. The central plate of the feed network is connected to a feed line that conveys a signal received by way of the antenna array to a receiver that is configured to perform one or more operations based on the signal received by way of the antenna.

By way of example, electromagnetic (EM) radiation impinges upon the arc-shaped portions of the dipole antennas, inducing a voltage that comprises the electrical signal. The signal travels along the slots and couples to the arms of the feed network where the arms cross the slot. The signal travels along the arms of the feed network to the central plate of the feed network. The signal is conveyed from the central plate along the feed line to a receiver, whereupon the receiver performs one or more operations with respect to the signal, or outputs data indicative of an amplitude of the signal. Geometric parameters of the feed network and the dipoles can be used as tuning parameters for the antenna array. Thus, the antenna array is well-suited to applications and environments in which precise tuning of an antenna is required (e.g., a dual-band GPS antenna in close proximity to other radiating antennas).

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
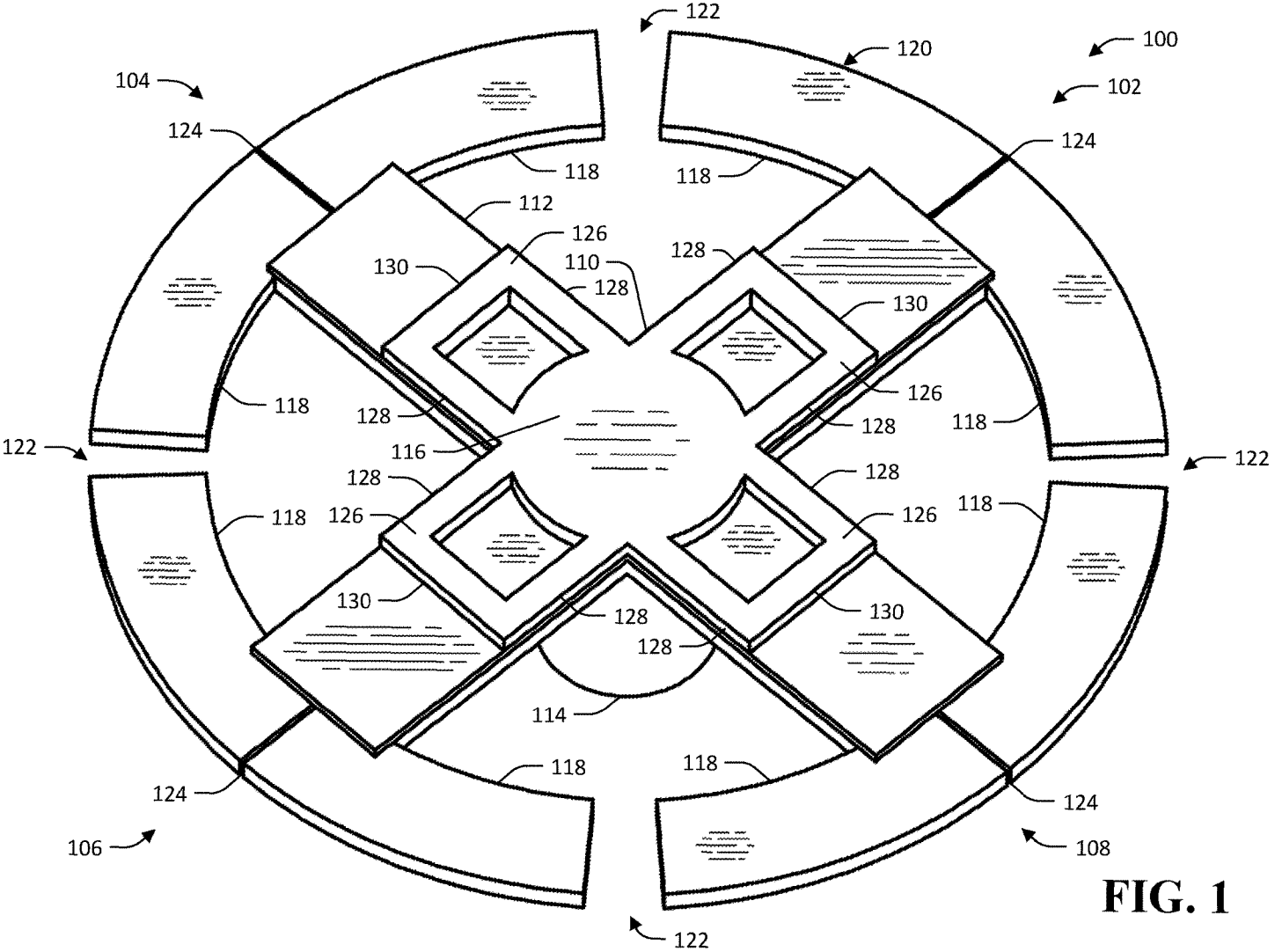
FIG. 1 is a perspective view of an exemplary antenna array.

Various technologies pertaining to an antenna array suitable for use as a dual-band GPS antenna are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Further, as used herein, the terms "component" and "system" are intended to encompass computer-readable data storage that is configured with computer-executable instructions that cause certain functionality to be performed when executed by a processor. The computer-executable instructions may include a routine, a function, or the like. It is also to be understood that a component or system may be localized on a single device or distributed across several devices. Additionally, as used herein, the term "exemplary" is intended to mean serving as an illustration or example of something, and is not intended to indicate a preference.

With reference to FIG. 1, a perspective view of an exemplary antenna array 100 that is suitable for use as a dual-band GPS antenna is illustrated. The array 100 includes four dipole antennas 102-108, a feed network 110 that couples the dipoles 102-108 to a feed line (not shown), and an insulating plate 112 that separates the dipoles 102-108 and the feed network 110. The exemplary array 100 is shown mounted on a post 114 that supports the array 100 and contains the feed line (not shown). The arrangement and construction of the antenna array 100 is found to provide the capability to reliably receive signals in the L1 and L2 GPS bands while mitigating electromagnetic (EM) coupling from nearby emission sources (e.g., vertically-polarized antennas).

The dipole antennas 102-108 are arranged in a coplanar, circular pattern around a central point that approximately coincides with a center of a central plate 116 of the feed network 110. Each of the dipole antennas 102-108 comprises two arc-shaped portions 118. The outer edges (e.g., outer edge 120) of the arc-shaped portions 118 form a substantially circular shape. The arc-shaped portions 118 of each of the dipoles 102-108 are separated from the arc-shaped portions 118 of adjacent dipoles by gaps 122. As used herein with respect to the array 100, adjacent dipoles are those arranged next to each other in a sequence going around the circular pattern of the array 100. Thus, for example, the dipole 102 is adjacent to dipoles 104 and 108, but not dipole 106. The two arc-shaped portions 118 of each of the dipoles 102-108 are separated from each other by slots 124 that each run along the length of a respective dipole in the dipoles 102-108.

The feed network 110 comprises the central plate 116 and four arms 126 that extend outward from the central plate 116 toward the outer edges of the arc-shaped portions 118 of the dipoles 102-108. Each of the arms 126 comprises two extension portions 128 that extend outward from the central plate 116. Each of the arms 126 further comprises a crossbar 130 that links the two extension portions 128 of the arm. The crossbar 130 of each of the arms 126 crosses over one of the slots 124 in the dipoles 102-108. During transmission, an electrical signal travels from the central plate 116 to the arms 126, where the signal travels along the extension portions 128 and then across the crossbars 130. As the signal travels across the crossbars 130, the signal couples to the corresponding slots 124. The signal then travels along the slots 124 and is radiated outward at the outer edges of the arc-shaped portions 118 of the dipoles 102-108. Reciprocally, during reception EM energy impinges on the outer edges of the dipoles 102-108 and induces an electrical signal that travels down the slots 124 toward the center of the array 100. As the signal travels down the slots 124 and crosses the crossbars 130, the signal couples to the crossbars 130 of the arms 126 and travels along the arms 126 to the central plate 116 of the feed network 110. The signal is then passed along the feed line where it can be received by an electronic device such as an RF receiver. In a transmission mode, EM energy radiates outward from the outer edges of the arc-shaped portions 118 of the dipoles 102-108 in a conical beam pattern. As a result, the array 100 is omnidirectional, as the radiation pattern of the array 100 extends radially outward from the antenna in all directions.

The feed network 110 is configured to function as a balun that matches impedance of the dipoles 102-108 to the impedance of a feed line that transfers electrical signals to and from the feed network 110. In an exemplary embodiment, each of the dipole antennas 102-108 is configured such that the total impedance of the network of dipole antennas is matched to the impedance of the transmission line. By way of example, each of the dipole antennas 102-108 in the array 100 can be configured to have an impedance of approximately 200Ω, such that the parallel combination of the four antennas 102-108 has an equivalent impedance approximately equal to a standard 50-Ω feed line.

The dipoles 102-108 are horizontally polarized, such that a wave transmitted from the array 100 along a line coplanar with the dipoles 102-108 has its electric field oscillating in the plane of the dipoles 102-108. The horizontal polarization of the dipoles 102-108 mitigates undesirable coupling between the dipoles 102-108 and the environment in which the array 100 is deployed. For example, the horizontal polarization of the dipoles 102-108 mitigates coupling between the dipoles 102-108 and orthogonally-polarized antennas that are in close proximity (e.g., within six inches) to the array 100.

Figure 2:
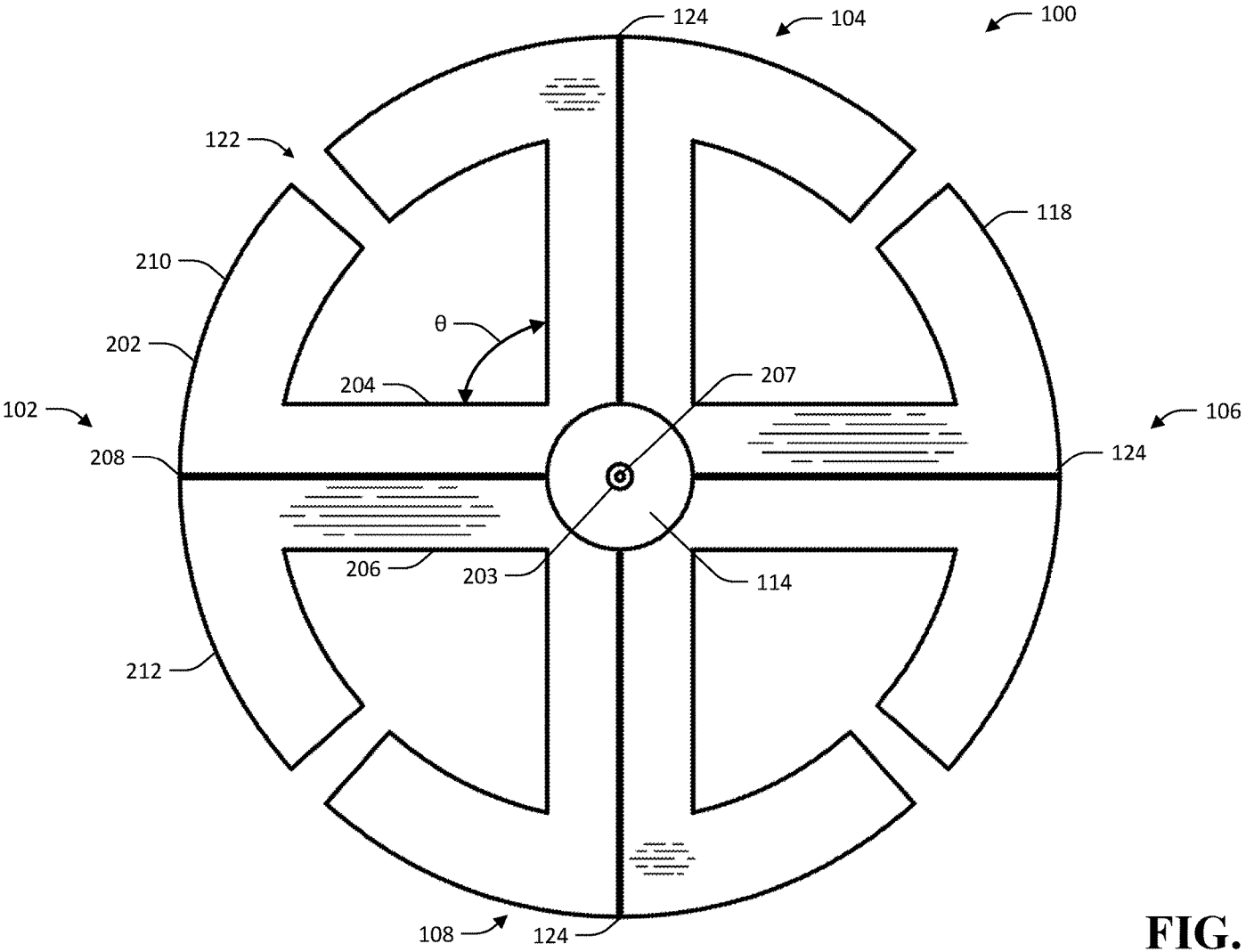
FIG. 2 is a bottom view of the exemplary antenna array.

Referring now to FIG. 2, a bottom view of the array 100 that illustrates the geometry of the dipole antennas 102-108 in greater detail is shown. The bottom view of the array 100 shows a single metal sheet 202 from which the dipoles 102-108 are formed. Further illustrated in the bottom view of FIG. 2 is a cross-sectional view of the post 114, showing a feed line 203 that extends through the sheet 202 that comprises the dipoles 102-108 and to the feed network 110 (i.e., in a direction extending into the page).

Certain exemplary features of each of the dipoles 102-108 are now described with respect to the dipoles 102 and 104. However, as will be understood by one of skill in the art, these features are applicable to any or all of the dipoles 104-108, necessary modifications being made. The dipole 102 comprises two straight arm portions 204, 206 that extend in a direction outward from a center 207 of the array 100. The straight arm portions 204, 206 are separated by a slot 208 that runs along the length of the straight arm portions 204, 206. The slot 208 extends along the length of the straight arm portions 204, 206 of the dipole 102 but does not extend through the center 207 of the sheet 202. Thus, in the portion of the sheet 202 that is obscured by the post 114 in FIG. 2, the slots 124, 208 terminate before connecting with one another. Thus, the dipoles 102-108 are not physically separated but rather are cut into the same metal sheet 202 such that the metal sheet 202 remains a single contiguous piece.

The dipole 102 further comprises a first arc-shaped portion 210 that extends from the first straight arm portion 204 and a second arc-shaped portion 212 that extends from the second straight arm portion 206. The arc-shaped portions 210, 212 extend along a circle that has the center 207 of the array 100 as its center. The arc-shaped portions 210, 212 extend along the circle toward the arc-shaped portions of adjacent dipoles 104 and 108.

The straight arm portions of adjacent dipoles in the dipoles 102-108 are arranged at an angle θ with respect to one another. In the exemplary array 100 the angle θ is approximately equal to 90°. While the exemplary array 100 depicted in FIGS. 1-4 is shown and described as including the four dipole antennas 102-108, it is to be understood that other embodiments can include a different number of dipole antennas. For example, in another embodiment the antenna array could include five dipole antennas. In such an example, the straight arm portions of adjacent dipoles in the five dipole antennas would form an angle of 72° to maintain the circular pattern of the dipoles. Similarly, in an embodiment wherein the antenna array includes three dipole antennas, the straight arm portions of adjacent dipoles would form an angle of 120° (360° divided by three dipoles).

Figure 3:
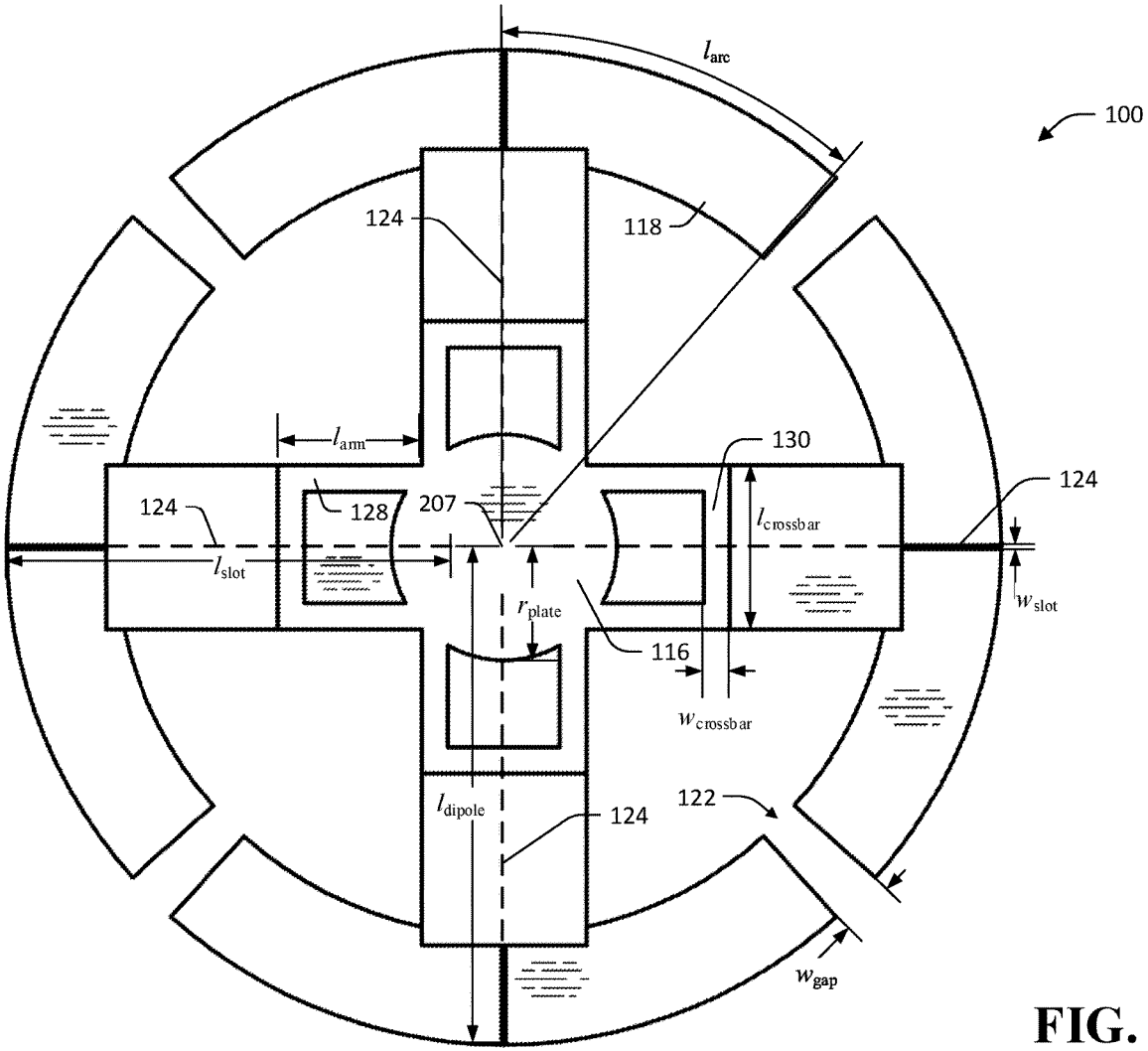
FIG. 3 is a top view of the exemplary antenna array.

Referring now to FIG. 3, a top view of the exemplary array 100 is shown, which illustrates certain features pertaining to the slots 124 and the arms 126 of the feed network 110. FIG. 3 depicts the slots 124 with dashed lines indicating the location of the slots 124 where obscured by the insulating plate 112 and the feed network 110. As described above with respect to FIG. 2, the slots 124 extend from the outer edges of the dipoles toward the center 207 of the array 100, but do not cross the center 207 of the array. Further, each of the crossbars 130 crosses over a different one of the slots 124, and EM energy couples from the arms 126 to the slots 124 where the crossbars 130 cross the slots 124.

Various parameters pertaining to geometry of the dipole antennas 102-108 and the feed network 110 can be tuned in order to tune the array 100 to receive or transmit in one or more frequency bands. For example, and referring again to FIG. 3, parameters of the feed network 110 can be modified to tune the array 100. Physical parameters of the feed network 110 include features such as a radius of the central plate 116, $r_{plate}$; a length of the extending portions of the arms 128, $l_{arm}$; a length of the crossbars 130, $l_{crossbar}$; a width of the crossbars 130, $w_{crossbar}$, etc. By way of other examples, parameters of the dipole antennas 102-108 can be modified to tune the array 100. Physical parameters of the dipole antennas 102-108 include features such as a length of the slots 124, $l_{slot}$; a width of the slots 124, $w_{slot}$; a length of the dipoles 102-108, $l_{dipole}$; an arc length of the arc-shaped portions 118 of the dipoles 102-108, $l_{arc}$; a width of the gap between the arc-shaped portions 118, $w_{gap}$, etc. While certain exemplary tuning parameters are highlighted herein, it is to be understood that other parameters of the array 100 may be modified in order to tune the array 100. In one exemplary embodiment, array 100 can be tuned for dual-band GPS, including the L1 GPS frequency of 1.575 GHz and the L2 GPS frequency of 1.227 GHz. While the array 100 is suitable for reception of dual-band GPS signals, it is to be understood that the physical parameters of the array 100 can be modified to tune the array 100 for reception or transmission of other signals.

Figure 4:
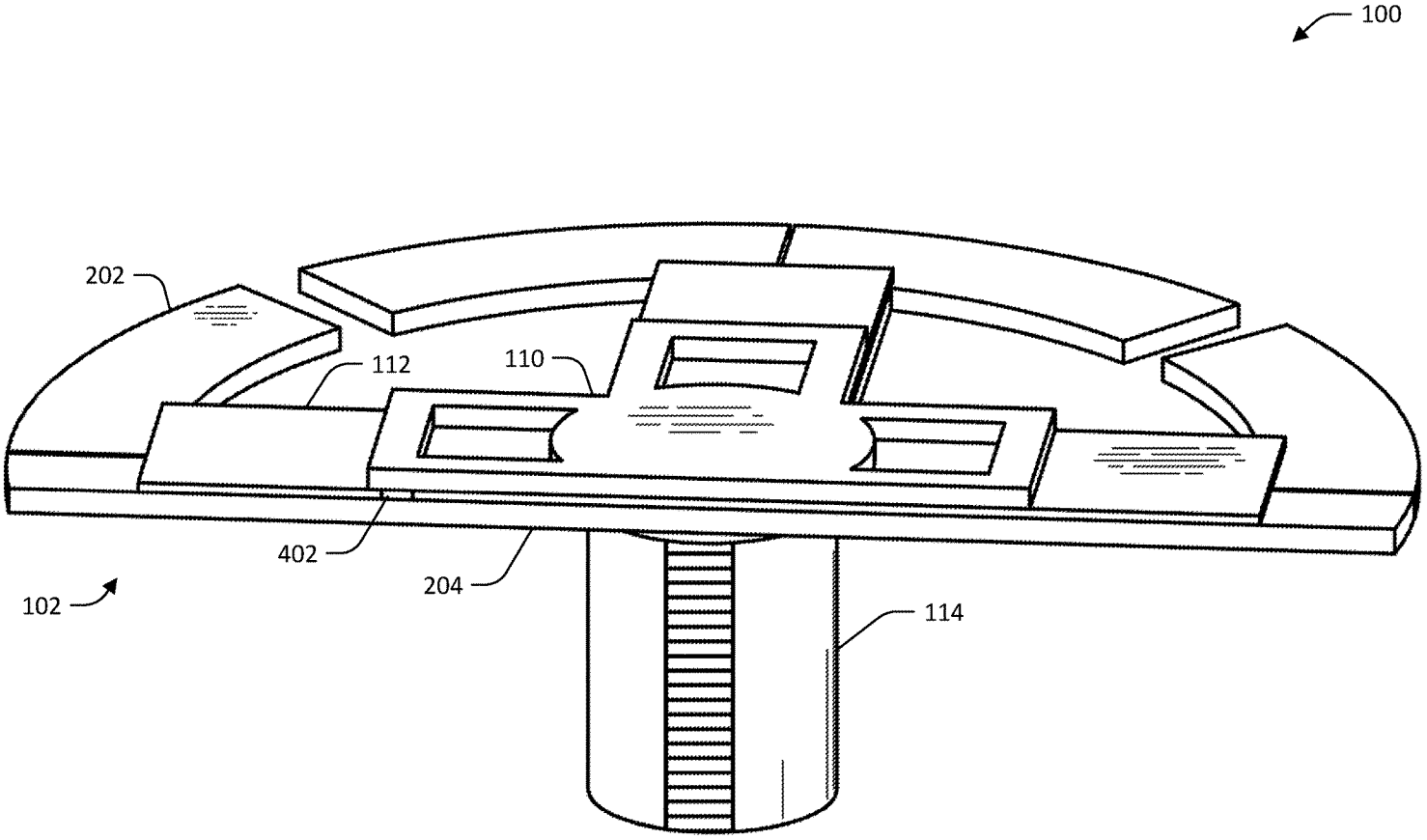
FIG. 4 is a cross-sectional view of the exemplary antenna array.

Referring now to FIG. 4, a cross-sectional side view of the exemplary antenna array 100 is shown, illustrating certain additional features of the feed network 110. In particular, as shown in FIG. 4 the feed network 110 includes a shorting pin 402 that connects the feed network 110 to the straight arm portion 204 of dipole 102. The shorting pin 402 extends from one of the arms 126 of the feed network 110 and through the insulating plate 112 to the straight arm portion 204 of the dipole 102. The shorting pin 402 provides a conductive path between the feed network 110 and the dipole 102. The shorting pin 402 therefore mitigates electrostatic discharge (ESD) between the feed network 110 and the dipoles 102-108 by preventing buildup of a charge imbalance between the feed network 110 and the dipoles 102-108. The shorting pin 402 can also improve thermal characteristics of the array 100 by more evenly spreading heat across components of the array 100. In an exemplary embodiment, the shorting pin 402 comprises a screw or other conducting fastener that extends through the insulating plate 112 and fastens the feed network 110 to the sheet 202 that comprises the dipoles 102-108. Therefore, in addition to mitigating ESD, the shorting pin 402 can provide additional structural stability to the antenna array 100.

Figure 5:
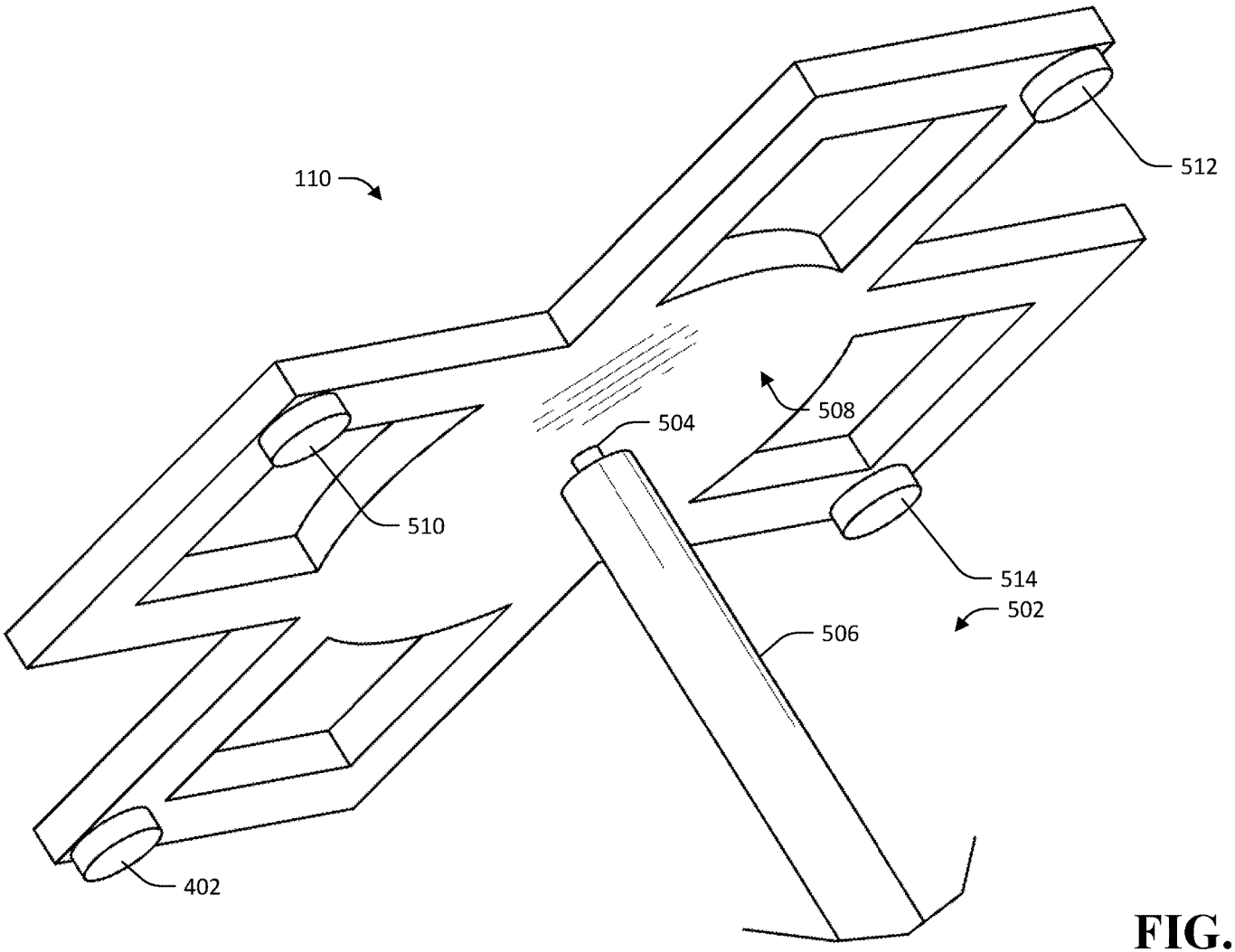
FIG. 5 is a diagram of an exemplary feed line and feed network of an antenna array.

Referring now to FIG. 5, the feed network 110 and a coaxial cable 502, functioning as the feed line 203, are shown apart from the remainder of the array 100. The coaxial cable 502 comprises a conducting core element 504 and a conducting shield 506 separated from the core element 504 by an insulating shield (not shown). The conducting core 502 and shield 506 connect to a bottom side 508 of the feed network 110. The feed network 110 comprises the shorting pin 402 and shorting pins 510-514, each of which connects to a different dipole in the dipoles 102-108. As described above with respect to FIG. 4, the shorting pins 402, 510-514 mitigate ESD between the feed network 110 and the dipoles 102-108, and can provide structural stability where the pins 402, 510-514 are used to fasten together the feed network 110 and the sheet 202 that comprises the dipoles 102-108.

The array 100 can be constructed in various ways using different materials. In one exemplary embodiment, the feed network 110 and the sheet 202 comprising the dipoles 102-108 are machined from pieces of a conducting metal such as aluminum. In the example, the machined pieces are separated by a layer of polytetrafluoroethylene (PTFE) that serves as the insulating layer 114. The pieces making up the feed network 110 and the sheet 202 can be joined by screws that extend through the feed network 110, the insulating plate 112, and at least a portion of the sheet 202 comprising the dipoles 102-108. These screws can function as the shorting pins 402, 510-514. In the exemplary embodiment, the pieces of aluminum that make up the feed network 110 and the dipoles 102-108 can be relatively thick (e.g., between 1/32 inches and 1/2 inch) in order to provide structural stability and to allow the array to withstand environments of high intensity shock and vibration. To further enhance structural stability and resistance to shock and vibration, the array 100 can be entirely or partially encased in an insulating material (e.g., PTFE).

While the array 100 is shown in FIGS. 1-4 as being free-standing, it is to be understood that components of the array 100 can be printed on a substrate such as a circuit board. For example, in another embodiment the sheet 202 comprising the dipoles 102-108 can be printed on a first side of a substrate and the feed network 110 can be printed on a second side of the substrate opposite to the first side. In this example, the substrate functions as the insulating plate 112 between the dipoles 102-108 and the feed network 110. In such an embodiment, the feed line that connects to the feed network 110 may be a trace on the surface of the substrate (e.g., the second side of the substrate on which the feed network 110 is printed).

Figure 6:
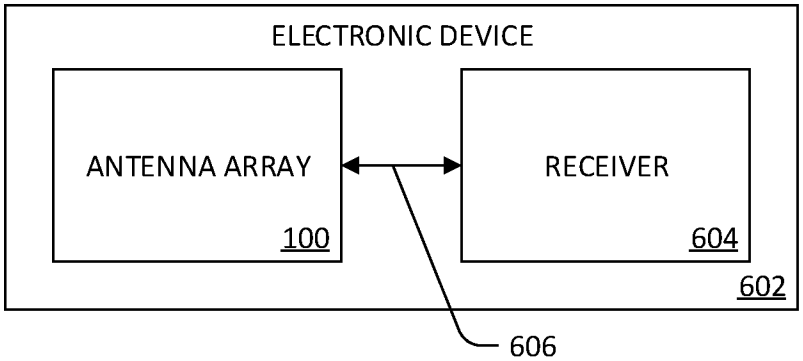
FIG. 6 is a functional block diagram of an electronic device incorporating the exemplary antenna array.

Referring now to FIG. 6, an electronic device 602 that incorporates the array 100 is illustrated. The electronic device 602 comprises the antenna 100 and a receiver 604 that are linked by a feed line 606 (e.g., a coaxial cable, circuit trace, etc.). The electronic device 602 can be substantially any device that includes the antenna 100 and an interface for generating data or performing other operations based on electrical signals output by the antenna (e.g., the interface comprises the receiver 604). For example, the electronic device 602 may be, or be included on, an aerial vehicle, a portable electronic device such as a smartphone, etc. The receiver 604 receives an electrical signal from the antenna array 100 by way of the feed line 606, where the electrical signal is representative of an EM wave received at the antenna array 100. As discussed above, a feed line connects the feed network of an antenna to a receiver and/or transmitter to allow a receiver to receive signals from the antenna and to allow a transmitter to transmit signals by way of the antenna. Responsive to receiving the electrical signal from the antenna array 100, the receiver 604 performs one or more operations based upon the electrical signal, or outputs data indicative of an amplitude of the electrical signal. For example, the receiver 604 can output a stream of digital values corresponding to a sampled value of the amplitude of the electrical signal for a plurality of times. In other embodiments, the receiver 604 may decode the electrical signal received from the antenna array 100 to retrieve a data signal encoded on a carrier received by way of the antenna array 100.

Figure 7:
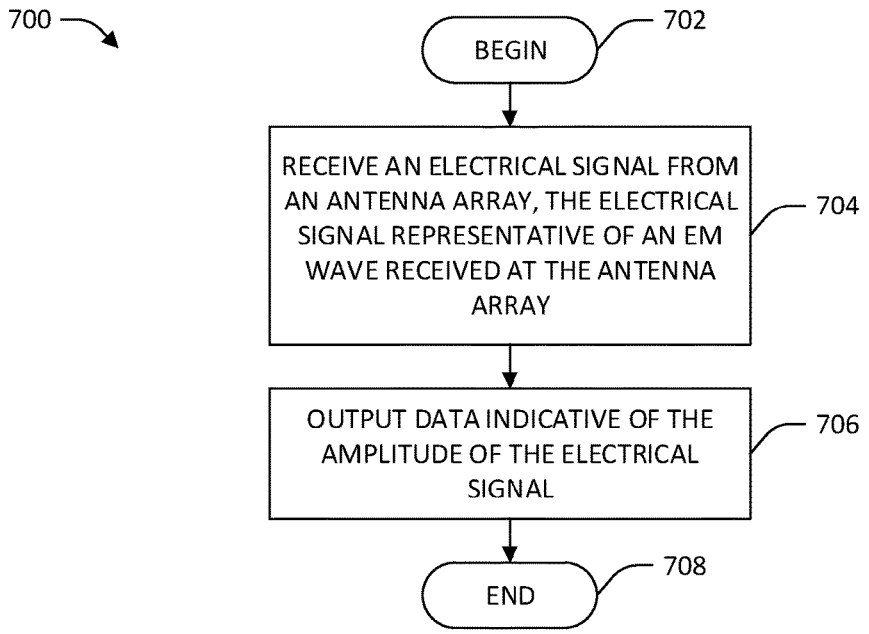
FIG. 7 is a flow diagram that illustrates an exemplary methodology for using an antenna array.

FIG. 7 illustrates an exemplary methodology relating to use of an antenna array suitable for dual-band GPS. While the methodology is shown and described as being a series of acts that are performed in a sequence, it is to be understood and appreciated that the methodology is not limited by the order of the sequence. For example, some acts can occur in a different order than what is described herein. In addition, an act can occur concurrently with another act. Further, in some instances, not all acts may be required to implement a methodology described herein.

Moreover, the acts described herein may be computer-executable instructions that can be implemented by one or more processors and/or stored on a computer-readable medium or media. The computer-executable instructions can include a routine, a sub-routine, programs, a thread of execution, and/or the like. Still further, results of acts of the methodology can be stored in a computer-readable medium, displayed on a display device, and/or the like.

Referring now to FIG. 7, a methodology 700 for using the antenna array described herein is illustrated. The methodology 700 begins at 702, and at 704 an electrical signal is received from an antenna array, where the electrical signal is representative of an EM wave received at the antenna array. The antenna array from which the signal is received at 704 can be, for example, the antenna array 100 described with respect to FIGS. 1-5. The signal received from the antenna array can be received at a computing device or other electronic device configured to perform one or more operations based upon the signal. At 706, data indicative of the amplitude of the electrical signal is output, whereupon the methodology 700 ends 708.

Various functions described herein with respect to the method of using the antenna array can be implemented in hardware, software, or any combination thereof. For example, functions described with respect to outputting data indicative of an electrical signal received by way of the antenna can be implemented by a combination of hardware and software elements. If implemented in software, the functions can be stored on or transmitted over as one or more instructions or code on a computer-readable medium. Computer-readable media includes computer-readable storage media. A computer-readable storage media can be any available storage media that can be accessed by a computer. By way of example, and not limitation, such computer-readable storage media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, include compact disc (CD), laser disc, optical disc, digital versatile disc (DVD), floppy disk, and blu-ray disc (BD), where disks usually reproduce data magnetically and discs usually reproduce data optically with lasers. Further, a propagated signal is not included within the scope of computer-readable storage media. Computer-readable media also includes communication media including any medium that facilitates transfer of a computer program from one place to another. A connection, for instance, can be a communication medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio and microwave are included in the definition of communication medium. Combinations of the above should also be included within the scope of computer-readable media.

Alternatively, or in addition, the functionally described herein can be performed, at least in part, by one or more hardware logic components. For example, and without limitation, illustrative types of hardware logic components that can be used include Field-programmable Gate Arrays (FPGAs), Program-specific Integrated Circuits (ASIC s), Program-specific Standard Products (ASSPs), System-on-a-chip systems (SOCs), Complex Programmable Logic Devices (CPLDs), etc.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. An antenna array, comprising:

a plurality of dipole antennas arranged in a circular pattern;

a feed network comprising:

a central plate connected to a feed line; and a plurality of arms extending from the central plate and arranged such that electromagnetic (EM) energy from each arm couples to a portion of a respective dipole antenna in the dipole antennas; and an insulating plate situated between the dipole antennas and the feed network.

2. The antenna array of claim 1, wherein the plurality of dipole antennas are arranged in a same plane.

3. The antenna array of claim 1, wherein each of the arms comprises a shorting pin that connects the arm to a respective dipole antenna.

4. The antenna array of claim 1, wherein the insulating plate comprises polytetrafluoroethylene (PTFE).

5. The antenna array of claim 1, wherein the plurality of arms are arranged such that the EM energy from each arm couples capacitively to the portion of the respective dipole antenna.

6. The antenna array of claim 1, wherein the feed line comprises a coaxial cable that runs through the insulating plate to the central plate of the feed network.

7. The antenna array of claim 1, wherein the dipole antennas and the feed network are printed on opposite sides of a same substrate, the insulating plate comprising the substrate.

8. The antenna array of claim 1, wherein the dipole antennas are configured to have a horizontally polarized emission pattern.

9. The antenna array of claim 1, wherein each of the dipole antennas comprises:

a first straight arm portion extending outward from a center of the circular pattern;

a second straight arm portion extending outward from the center of the circular pattern, the second straight arm portion separated from the first straight arm portion by a slot running the length of the first straight arm portion and the second straight arm portion;

a first arc portion extending from the first straight arm portion; and a second arc portion extending from the second straight arm portion.

10. The antenna array of claim 9, wherein the straight arm portions of a first dipole antenna in the dipole antennas extend from the center of the circular pattern at an angle to the straight arm portions of a second dipole antenna in the dipole antennas.

11. The antenna array of claim 9, wherein for each of the dipole antennas, the first straight arm portion and the second straight arm portion extend in a same direction as a respective arm in the arms of the feed network.

12. The antenna array of claim 1, wherein the plurality of dipole antennas comprises four dipole antennas and the plurality of arms extending from the central plate of the feed network comprises four arms.

13. The antenna array of claim 1, wherein the antenna array is tuned for reception in L1 and L2 GPS bands.

14. The antenna array of claim 1, wherein the dipole antennas are formed from a single metal sheet.

15. The antenna array of claim 1, wherein each of the arms of the feed network comprises:

a first portion extending outward from the central plate of the feed network;

a second portion extending outward from the central plate of the feed network in a same direction as the first portion; and a crossbar that connects the first portion of the arm to the second portion of the arm.

16. The antenna array of claim 15, each of the plurality of dipole antennas comprising a slot, and wherein the crossbar of each of the arms of the feed network crosses the slot of a respective dipole antenna in the dipole antennas, the EM energy couples from the crossbar to the slot of the respective dipole antenna.

17. A method for using an antenna array, the method comprising:

receiving an electrical signal from an antenna array that comprises:

a plurality of dipole antennas arranged in a circular pattern;

a feed network comprising:

a central plate connected to a feed line; and a plurality of arms extending from the central plate and arranged such that electromagnetic (EM) energy from each arm couples to a portion of a respective dipole antenna in the plurality of dipole antennas; and an insulating plate situated between the dipole antennas and the feed network; and responsive to receiving the electrical signal from the antenna array, the electrical signal representative of an EM wave received at the antenna array, performing one or more operations based on the electrical signal.

18. An electronic device comprising:

an antenna array that comprises:

a plurality of dipole antennas arranged in a circular pattern; and a feed network comprising:

a central plate connected to a feed line, the feed line connected to one or more components of the electronic device; and a plurality of arms extending from the central plate and arranged such that electromagnetic (EM) energy from each arm couples to a slot between two arms of a respective dipole antenna in the plurality of dipole antennas; and a receiver that receives an electrical signal from the antenna array, the electrical signal representative of an EM wave received at the antenna array, the receiver configured to output data indicative of the electrical signal.

19. The electronic device of claim 18, wherein a first arm in the arms of the feed network comprises a shorting pin that makes electrical contact between the feed network and a first dipole antenna in the dipole antennas.

* * * * *